US007475722B2

(12) United States Patent
Khehra et al.

(10) Patent No.: US 7,475,722 B2
(45) Date of Patent: Jan. 13, 2009

(54) METHOD AND APPARATUS FOR RESTRAINING TUBULAR MEMBERS DURING WELL SERVICING

(75) Inventors: Mehtab S. Khehra, Edmonton (CA); Irvin M. Slager, Tulum (MX)

(73) Assignee: 1128971 Alberta Ltd., Edmonton (CA)

( * ) Notice: Subject to any disclaimer, the term of this patent is extended or adjusted under 35 U.S.C. 154(b) by 68 days.

(21) Appl. No.: 11/548,675

(22) Filed: Oct. 11, 2006

(65) Prior Publication Data

US 2008/0017371 A1 Jan. 24, 2008

(30) Foreign Application Priority Data

Jul. 19, 2006 (CA) ..... 2553460

(51) Int. Cl.
*E21B 19/086* (2006.01)

(52) U.S. Cl. ..... 166/77.4; 166/66

(58) Field of Classification Search ..... 166/77.1, 166/77.4, 377, 380, 66
See application file for complete search history.

(56) References Cited

U.S. PATENT DOCUMENTS

| | | | |
|---|---|---|---|
| 3,797,570 | A | 3/1974 | Leutwyler |
| 3,999,610 | A | 12/1976 | Sage |
| 4,162,704 | A | 7/1979 | Gunther |
| 4,290,495 | A | 9/1981 | Elliston |
| 4,964,462 | A | 10/1990 | Smith |
| 5,014,781 | A | 5/1991 | Smith |
| 5,203,410 | A | 4/1993 | Cobb |
| 6,712,147 | B2 | 3/2004 | Dallas |
| 6,759,968 | B2 | 7/2004 | Zierolf |
| 2005/0055163 | A1 | 3/2005 | Hopper |

*Primary Examiner*—Hoang Dang
(74) *Attorney, Agent, or Firm*—Christensen O'Connor; Johnson Kindness PLLC

(57) ABSTRACT

A method for restraining tubular members during well servicing. A first step involves monitoring a velocity of tubular members as they are withdrawn from a well. A second step involves activating a tubing restrainer when the velocity of the tubular members exceeds a predetermined threshold.

13 Claims, 3 Drawing Sheets

METHOD AND APPARATUS FOR RESTRAINING TUBULAR MEMBERS DURING WELL SERVICING

FIELD

The present application relates to a method and associated apparatus for restraining tubular members during well servicing.

BACKGROUND

During oil or gas well servicing, "snubbing" units are used to insert tubular members into the well being serviced. There are dangers associated with snubbing operations. One danger is that of a "blow out" condition, caused by fluid pressure down hole. Blowout preventers that seal around the tubular members, such as U.S. Pat. No. 3,797,570 (Leutwyler), can be used to protect against such blow out conditions. Blowout preventers are ineffective in dealing with other dangers associated with snubbing operations.

SUMMARY

According to one aspect there is provided a method for restraining tubular members during well servicing. A first step involves monitoring a velocity of tubular members as they are withdrawn from a well. A second step involves activating a tubing restrainer when the velocity of the tubular members exceeds a predetermined threshold.

The teachings of this method helps avoid problems associated with equipment failure or operator error that a blow out preventer is incapable of addressing.

According to another aspect there is provided an apparatus for restraining tubular members during well servicing, which includes a body adapted for connection to a wellhead. The body has a passage adapted to permit movement of tubular members through the body, as the tubular members are inserted into or removed from a well. A controller is provided, along with at least one velocity sensor in communication with the controller and adapted to communicate to the controller a velocity of tubular members. A tubing restrainer is in communication with the controller. The tubing restrainer is adapted to restrain the tubular members moving through the passage when activated. The controller activates the tubing restrainer when the velocity of the tubular members, as indicated by the velocity sensor, exceeds a predetermined threshold.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
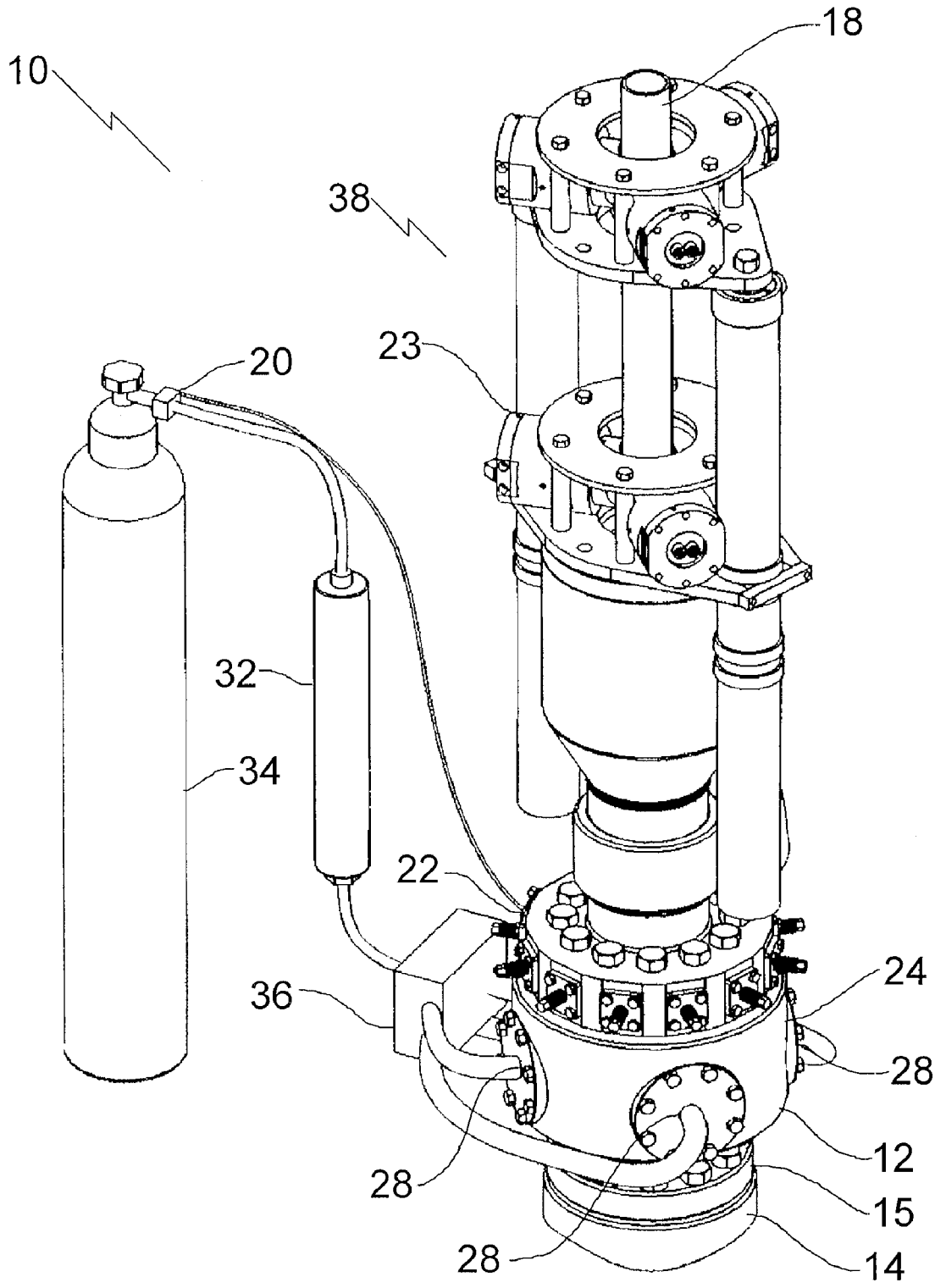
FIG. 1 is a perspective view of an apparatus for restraining tubular members during well servicing installed on a well head.

An apparatus for restraining tubular members during well servicing generally identified by reference numeral 10, will now be described with reference to FIGS. 1 through 4.

Figure 2:
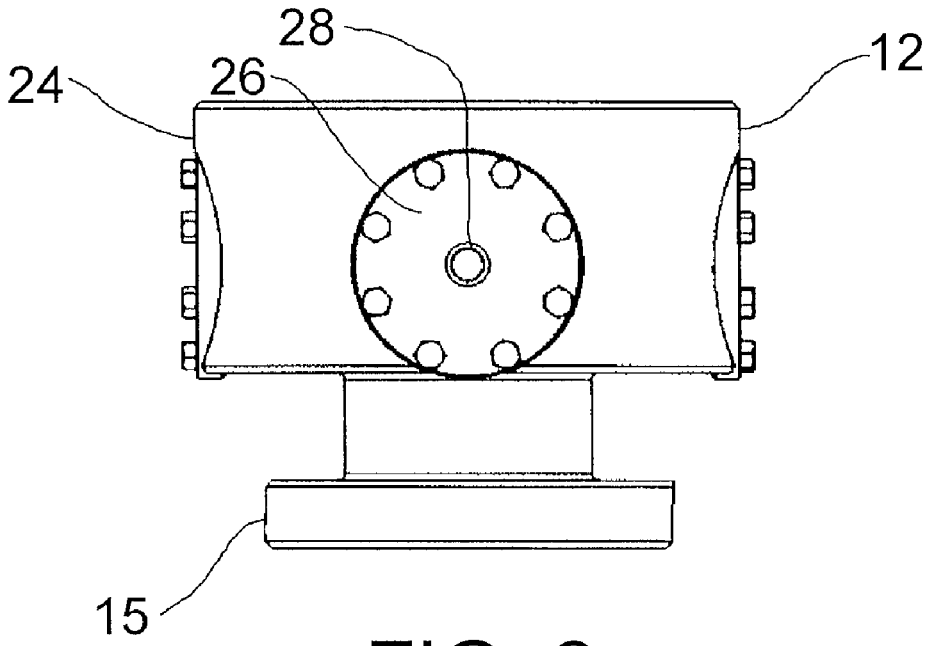
FIG. 2 is a side plan view of a tubing restrainer.
Figure 3:
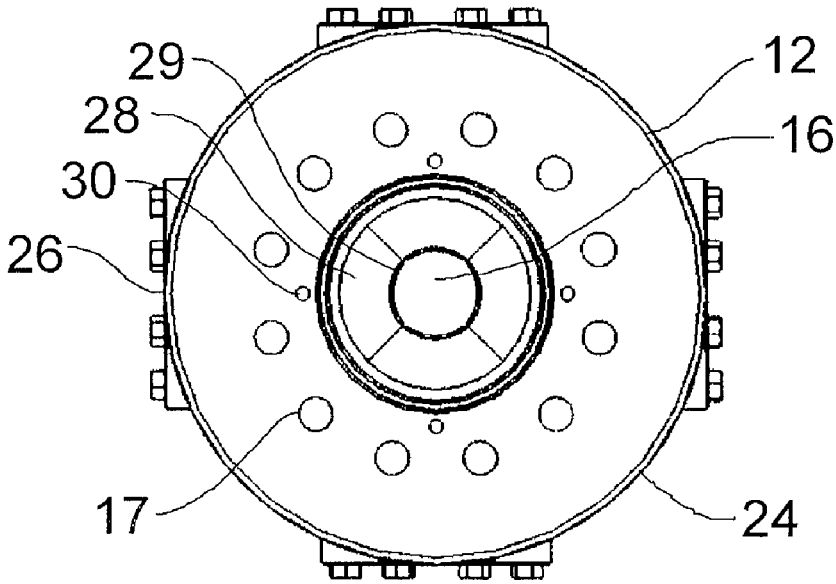
FIG. 3 is a top plan view of the tubing restrainer shown in FIG. 2.
Figure 4:
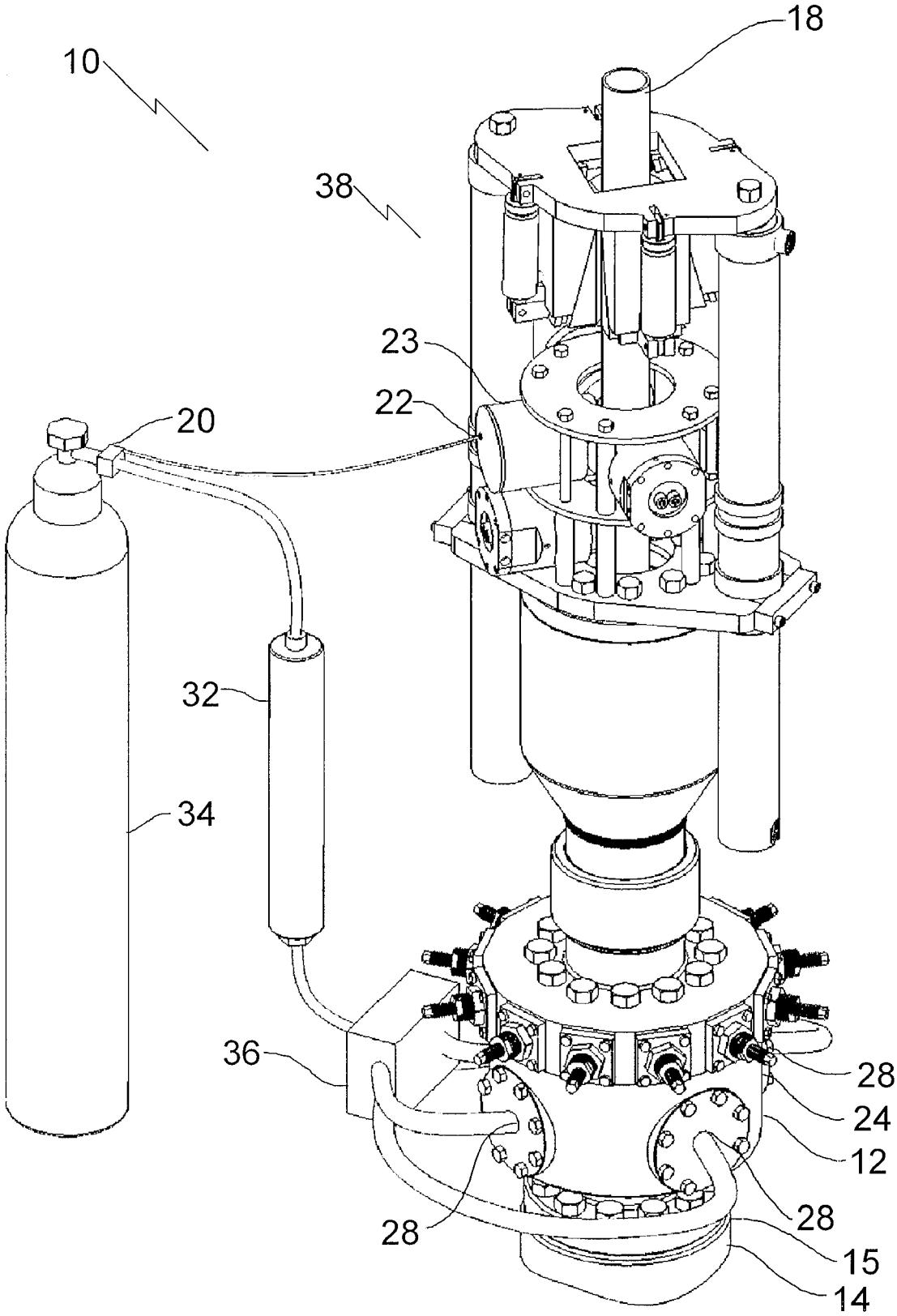
FIG. 4 is a perspective view of the apparatus for restraining tubular members shown in FIG. 1 with the speed sensor in an alternative location.

Structure and Relationship of Parts:

Referring to FIG. 1, apparatus 10 includes a body 12 to be connected to a wellhead 14. Referring to FIG. 2, a flange 15 is provided for this purpose. Referring to FIG. 3, threaded bolt holes 17 are also provided to attach further equipment. In addition, body 12 has a central passage 16 through body 12. Referring to FIG. 1, passage 16 is adapted to permit movement of tubular members 18 through body 12 as tubular members 18 are inserted into or removed from a well. There is also a controller 20 with a velocity sensor 22 in communication with controller 20 to communicate the velocity of tubular members 18 to controller 20. Velocity sensor 22 may either be mounted on body 12 as shown in FIG. 1 or spaced from body 12 as shown in FIG. 4. Referring to FIG. 4, velocity sensor 22 is positioned within a slip cylinder 23, which is part of the equipment 38 used to move tubular member 18 up and down. FIG. 1 shows another arrangement of equipment 38 that may be used, while other types may also be used as is known in the art. An example of a suitable velocity sensor 22 includes a contact wheel positioned against tubular member 18 connected to a rotary encoder. Other suitable sensors will be apparent to those skilled in the art. Referring again to FIG. 1, controller 20 is also in communication with a tubing restrainer 24, which is adapted to restrain tubular members 18 moving through passage 16 when activated. Tubing restrainer 24 is activated by controller 20 when the velocity of tubular members 18 as indicated by velocity sensor 22 exceeds a predetermined threshold. Referring to FIG. 3, tubing restrainer 24 has restraining elements 26 in the form of fluid activated pistons 28 with serrated grips 29 positioned radially about passage 16. Alignment pins 30 are used to align restraining elements 26. Different sizes of pistons 28 with serrated grips 29 may be provided depending on the size of tubular members 18. Referring to FIG. 1, tubing restrainer 24 is fluid-activated with a fluid source that includes an accumulator 32 connected to a supply of inert gas 34. An equal pressuring valve 36 is also connected between accumulator 32 and fluid-activated pistons 28 to ensure that each piston 28 receives an equal amount of pressure.

The accumulator contains pressurized gas, which can be fed into the item to which it is connected, such as a hydraulic or pneumatic system. The energy produced by the release of the gas serves as a motive force in the system to do the work, such as moving the fluid or actuating a valve.

Operation:

Referring to FIGS. 1 through 4, the use and operation of apparatus 10 as described above will now be given. Referring to FIG. 1, body 12 is installed on wellhead 14 with tubular member 18 passing through passage 16 (seen in FIG. 3). Equipment 38 above wellhead 14 and body 12 causes tubular member 18 moves up and down, while velocity sensor 22 monitors its velocity. If the velocity of tubular member 18 goes beyond a predetermined threshold for whatever reason, controller 20 activates tubing restrainer 24. Supply of inert gas 34 supplies accumulator 32 with inert gas, which is then allowed to flow through equal pressuring valve 36 to activate fluid-activated pistons 28. Serrated grips 29 on fluid-activated pistons 28 then engage tubular member 18 to stop its motion.

Advantages:

Current safety devices merely react to high pressures downhole. The present teachings act to protect workers in situations where tubing is travelling at dangerous speeds for a number of different reasons, such as operator error, slip failure, equipment failure, or a blowout.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. An apparatus for restraining tubular members during well servicing, comprising:

a body adapted for connection to a wellhead, the body having a passage adapted to permit movement of tubular members through the body as the tubular members are inserted into or removed from a well;

a controller;

at least one velocity sensor in communication with the controller and adapted to communicate to the controller a velocity of tubular members;

a tubing restrainer in communication with the controller, the tubing restrainer being adapted to restrain the tubular members moving through the passage when activated, the controller activating the tubing restrainer when the velocity of the tubular members as indicated by the velocity sensor exceeds a predetermined threshold.

2. The apparatus as defined in claim 1, wherein the tubing restrainer comprises restraining elements positioned radially about the passage.

3. The apparatus of claim 1, wherein the tubing restrainer is fluid-activated, the fluid-activated tubing restrainer being connected to a fluid source.

4. The apparatus of claim 3, wherein the fluid comprises an inert gas.

5. The apparatus of claim 3, wherein the fluid source comprises an accumulator connected to the fluid-activated tubing restrainer and a supply of fluid.

6. The apparatus of claim 2, wherein the restraining elements comprise fluid-activated pistons.

7. The apparatus of claim 6, wherein the fluid-activated tubing restrainer includes an equal pressuring valve connected to the fluid source and each of the fluid-activated pistons.

8. The apparatus of claim 1, wherein the restraining elements have serrated grips for gripping the tubing when activated.

9. The apparatus of claim 1, wherein the at least one velocity sensor is one of mounted on the body or spaced from body.

10. An apparatus for restraining tubular members during well servicing, comprising:

a body adapted for connection to a wellhead, the body having a passage adapted to permit movement of tubular members through the body as the tubular members are inserted into or removed from a well;

a controller;

at least one velocity sensor in communication with the controller and adapted to communicate to the controller a velocity of tubular members;

a tubing restrainer in communication with the controller, the tubing restrainer being adapted to restrain the tubular members moving through the passage when activated, the controller activating the tubing restrainer when the velocity of the tubular members as indicated by the velocity sensor exceeds a predetermined threshold, the tubing restrainer comprising restraining elements in the form of fluid activated pistons positioned radially about the passage, the tubing restrainer being fluid-activated with a fluid source that includes an accumulator connected to a supply of inert gas.

11. The apparatus of claim 10, wherein the fluid-activated tubing restrainer includes an equal pressuring valve connected to the fluid source and each of the fluid-activated pistons.

12. The apparatus of claim 10, wherein the restraining elements have serrated grips for gripping the tubing when activated.

13. The apparatus of claim 10, wherein the at least one velocity sensor is one of mounted on the body or spaced from body.

* * * * *